United States Patent [19]

Kao

[11] Patent Number: 4,682,967

[45] Date of Patent: Jul. 28, 1987

[54] MULTI-PURPOSE BUILDING BLOCK

[76] Inventor: Ching-Ho Kao, Fl. 7-2, No. 11, Yung Fu Road, Tainan, Taiwan

[21] Appl. No.: 775,743

[22] Filed: Sep. 13, 1985

[51] Int. Cl.[4] ..... H63H 63/06

[52] U.S. Cl. ..... 446/113; 52/DIG. 10; 434/403; 446/71; 446/115

[58] Field of Search ..... 52/79.4, 236.1, DIG. 10; 108/60, 62; 434/403, 432; 446/111, 71, 112, 108, 113, 115, 123, 482; D6/335, 421, 449

[56] References Cited

U.S. PATENT DOCUMENTS

| | | | |
|---|---|---|---|
| D. 220,997 | 6/1971 | Milburn | D6/335 |
| D. 283,278 | 4/1986 | Kent | D6/421 |
| 986,395 | 3/1911 | King | 52/79.4 X |
| 1,493,277 | 5/1924 | Pool | 446/71 |
| 3,564,787 | 2/1971 | Sherman | 446/108 X |
| 3,645,036 | 2/1972 | Biesterfeld | 446/113 X |
| 3,698,104 | 10/1972 | Sutton | 434/432 |
| 3,858,528 | 1/1975 | Petersen | D6/421 X |
| 3,869,992 | 3/1975 | Kramer | 108/60 |

*Primary Examiner*—William H. Grieb

*Attorney, Agent, or Firm*—Bacon & Thomas

[57] ABSTRACT

The present invention relates to a series of building blocks of different shapes, wherein each individual building block unit comprises a horizontal partition plate (2) which divides the unit block into upper and lower compartments, a supporting partition wall (1) wherein on the surface of supporting partition wall (1) at the upper compartment of the unit there is a row of equi-spaced hole. One of the characteristics of the building blocks is that three of the faces of the block are not enclosed by any plate. The block units may have a square, rectangular, semicircular or circular shape. The block units may also have a triangular, sector, trapezium or a truncated sector shape, each of the last four shapes having an angle of either 60°, 72° or 90°. Hence, there are altogether 16 types of blocks which can be arranged in many geometric shapes. By the stacking and arrangement of the unit block, the children can have better concept in dimensional structures, further, the size and the weight of the block is made with proportional to children's size, so that the children can play with it in groups.

3 Claims, 22 Drawing Figures

MULTI-PURPOSE BUILDING BLOCK

BACKGROUND OF INVENTION

According to the principles of education, children should be encouraged to be independent by providing a well-prepared learning environment during the critical learning period, i.e. at the age between 3 to 6. During this period, the children are essentially provided with sensorial material for the exploration of the environment such as solid cylinders or units of building blocks. Usually the blocks are made so that a combination can be obtained by engaging with other units accordingly. However, the prior arts of these kinds (please refer to FIG. 18) have various drawbacks as stated below:

(a) Most of the building blocks are made as an enclosed unit, therefore, only certain combinations can be arranged.

(b) All these building blocks can only be used as a game for the children and do not possess any other effective or useful functions.

(c) The size of the blocks is made either too large or too small, if it is too large, it occupies quite a large space; obviously, if the size is too small, there is no way to train the physical condition of the children.

SUMMARY OF THE INVENTION

The combination of building blocks using the individual unit in accordance with herein described invention, the invention does not possess all such above-mentioned drawbacks, but each unit can be engaged with other blocks by means of screws and nuts to form various combinations of any kind for purposely uses.

An object of the present invention is to provide a multi-purpose building block set for children, in which three faces of the block unit are not enclosed. Therefore, each unit can function as a chair or table or simply a toy. When the units of building blocks are arranged, different shapes and combinations can be formed.

An object of the present invention is to provide a multi-purpose building block as a playing game made into different combinations for the children.

It is another object of the present invention to provide multi-purpose building blocks in which the blocks can be used as table or chair or various size and combinations for the children. (Please refer to FIGS. 7, 8 and 11)

It is another object of the present invention to provide multi-purpose building blocks in which the different unit can be regarded as teaching aids in understanding geometrical shape formations and relationships between the single unit and the complete combinations and orientation of the units.

It is another object of the present invention to provide a multi-purpose building blocks in which the blocks can be arranged into a stable stage or furniture for children.

It is also another object of the present invention to provide a multi-purpose building block in which each unit can be arranged as bookshelf or a trays for displaying decorative objects.

It is another object of the present invention to provide a multi-purpose building block for children wherein the different geometrical shapes of building block units are suitable for children into training and prompting their imagination by forming visual combinations. Moreover, the weight of the unit is meant for children to carry in two or in group, in this way, the significance of this invention is presenting a sense of cooperation among the children, additionally, the combinations created by the children always encourage the children to make more combinations, hence, by doing this, the children not only can improve their physical condition but can also develop better relationships with other children.

It is another object of the present invention to improve the growth of the children's muscle and their hand-eye coordination.

In order that the present invention may be more readily understood and put into practical effect, reference will now be made to the accompanying drawings which illustrate preferred embodiment of the present invention and wherein.

DETAILED DESCRIPTION OF INVENTION

Figures 1, 1A, 1B:
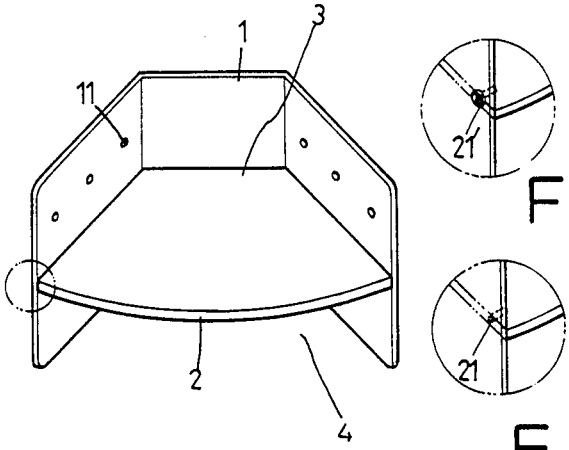
FIG. 1 is a perspective view of a building block unit in accordance with the present invention.
FIG. 1A is a view of a horizontal plate mounted to a vertical wall by means of a dowel.
FIG. 1B is a view of a horizontal plate mounted to a vertical wall by means of a flat-top screw.
Figure 2A:
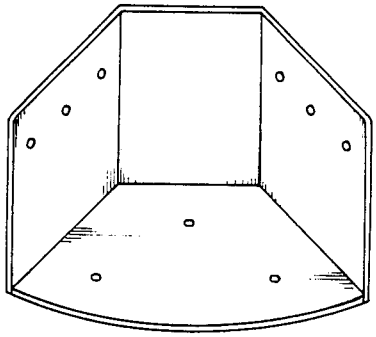
FIG. 2A is a perspective view of a building block unit in which a horizontal wall partition is mounted on a lower edge.
Figure 2B:
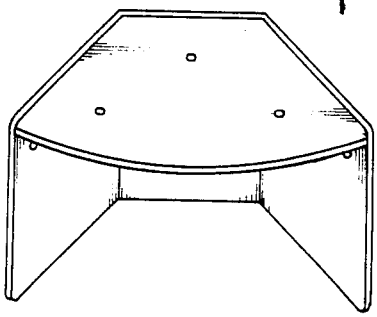
FIG. 2B is a perspective view of a building block unit in which a horizontal wall partition is mounted on an upper edge.
Figure 2C:
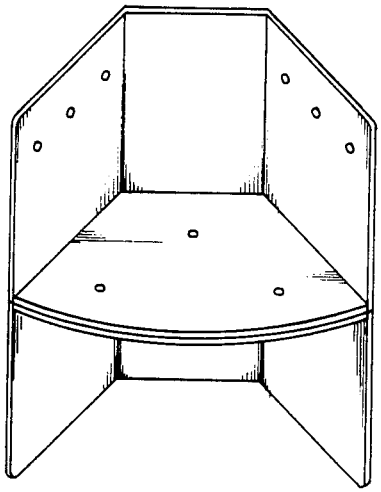
FIG. 2C is a perspective view of the building block units of FIGS. 2A and 2B secured together to form a chain.
Figure 3:
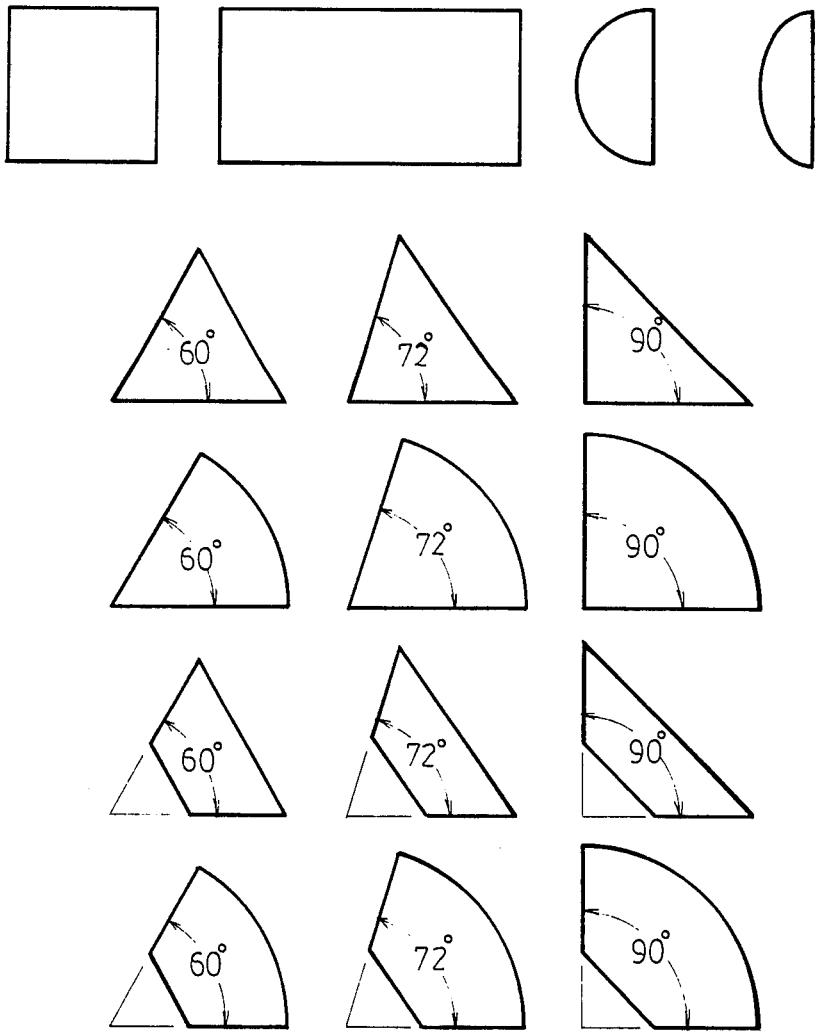
FIG. 3 is a top view of different building block units.
Figure 4:
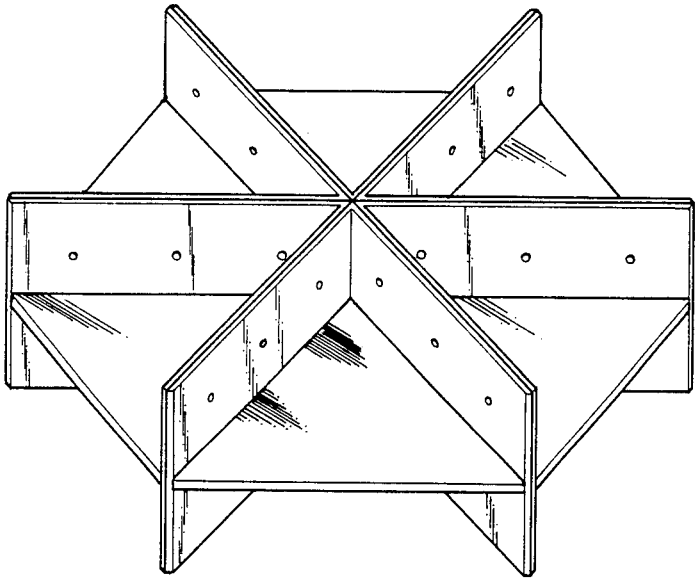
FIG. 4 is a perspective view of a first combination of building block units.
Figure 5:
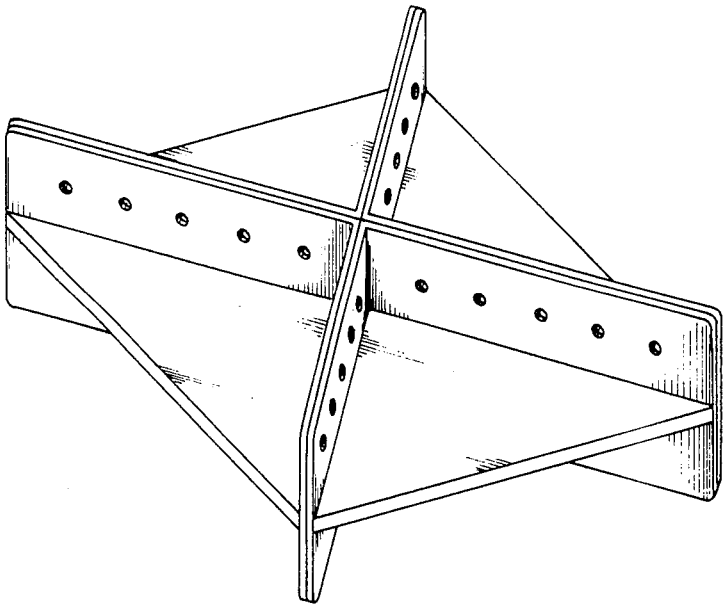
FIG. 5 is a perspective view of a second combination of building block units.
Figure 6:
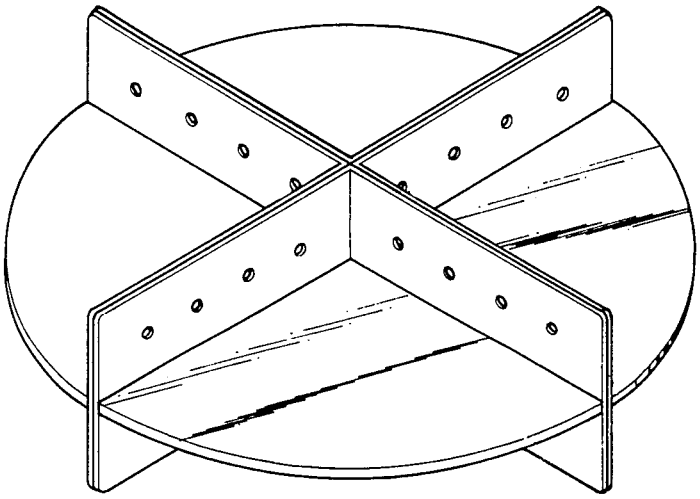
FIG. 6 is a perspective view of a third combination of building block units.
Figure 7:
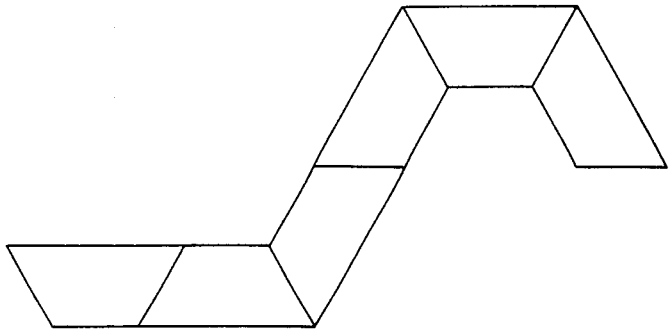
FIG. 7 is a top view of a fourth combination made with units of building blocks.
Figure 8:
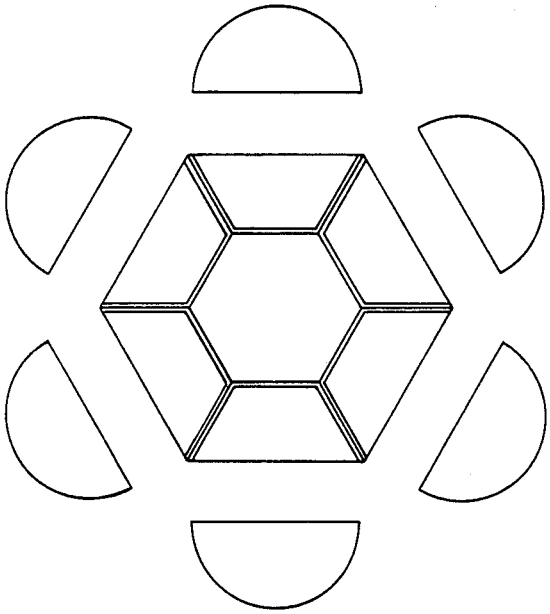
FIG. 8 is a top view of a fifth combination made with units of buildidng blocks.
Figure 9:
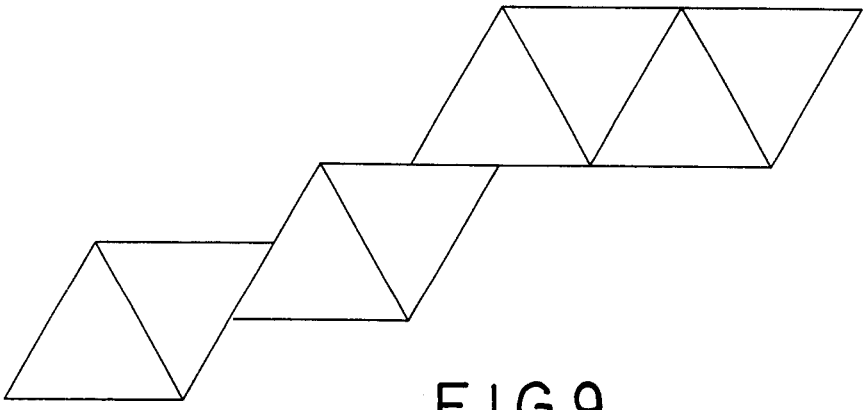
FIG. 9 is a top view of a sixth combination made with units of building blocks.
Figure 10:
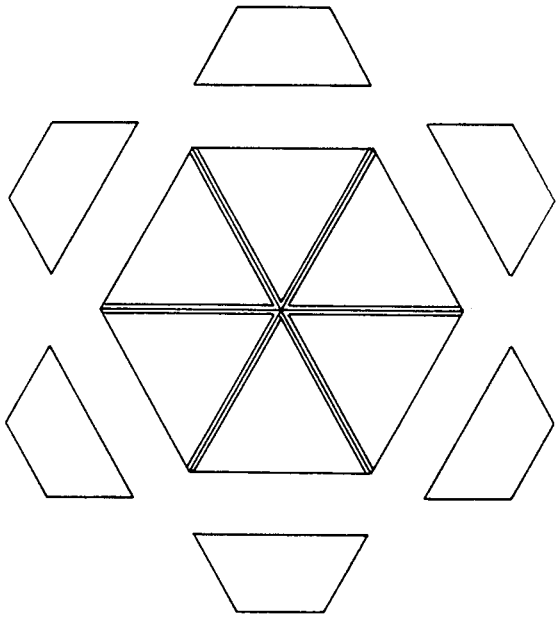
FIG. 10 is a top view of a seventh combination made with units of building blocks.
Figure 11:
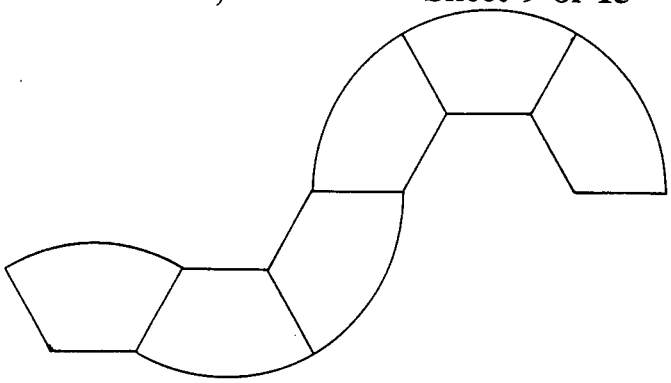
FIG. 11 is a top view of an eighth combination made with units of building blocks.
Figure 12:
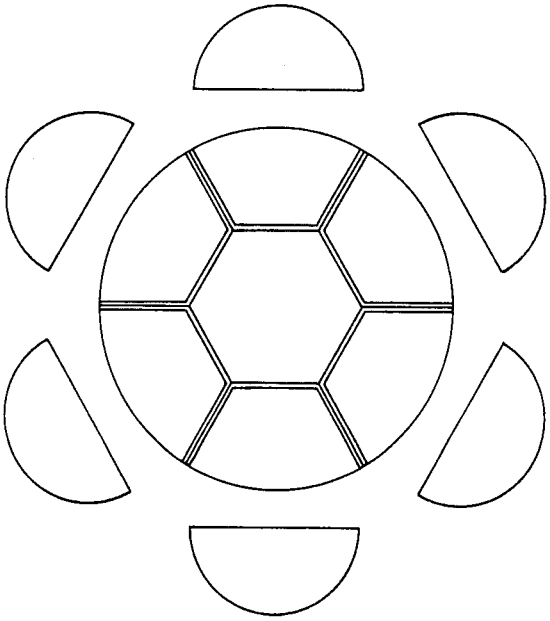
FIG. 12 is a top view of a ninth combination made with units of building blocks.
Figure 13:
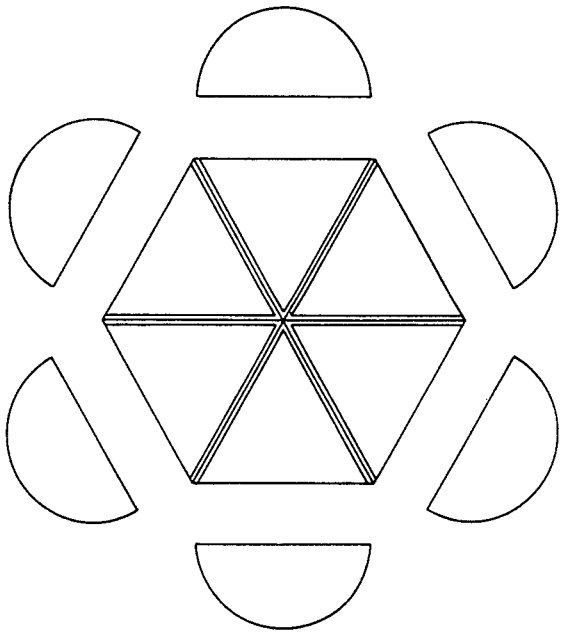
FIG. 13 is a top view of a tenth combination made with units of building blocks.
Figure 14:
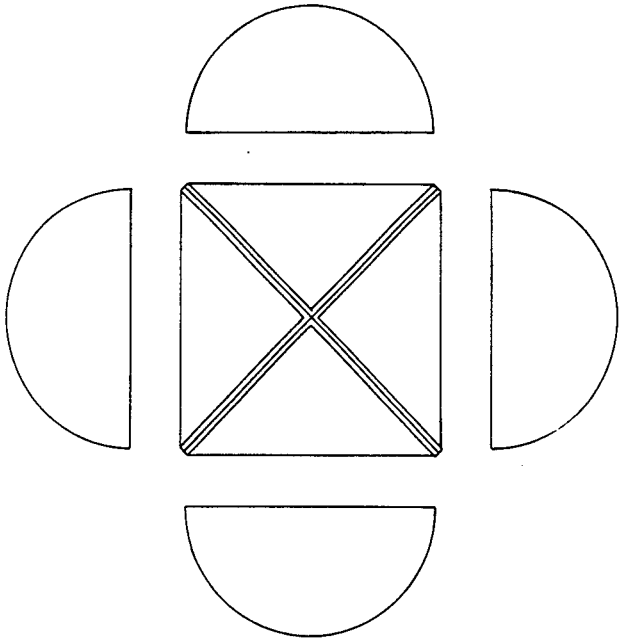
FIG. 14 is a top view of an eleventh combination made with units of building blocks.
Figure 15:
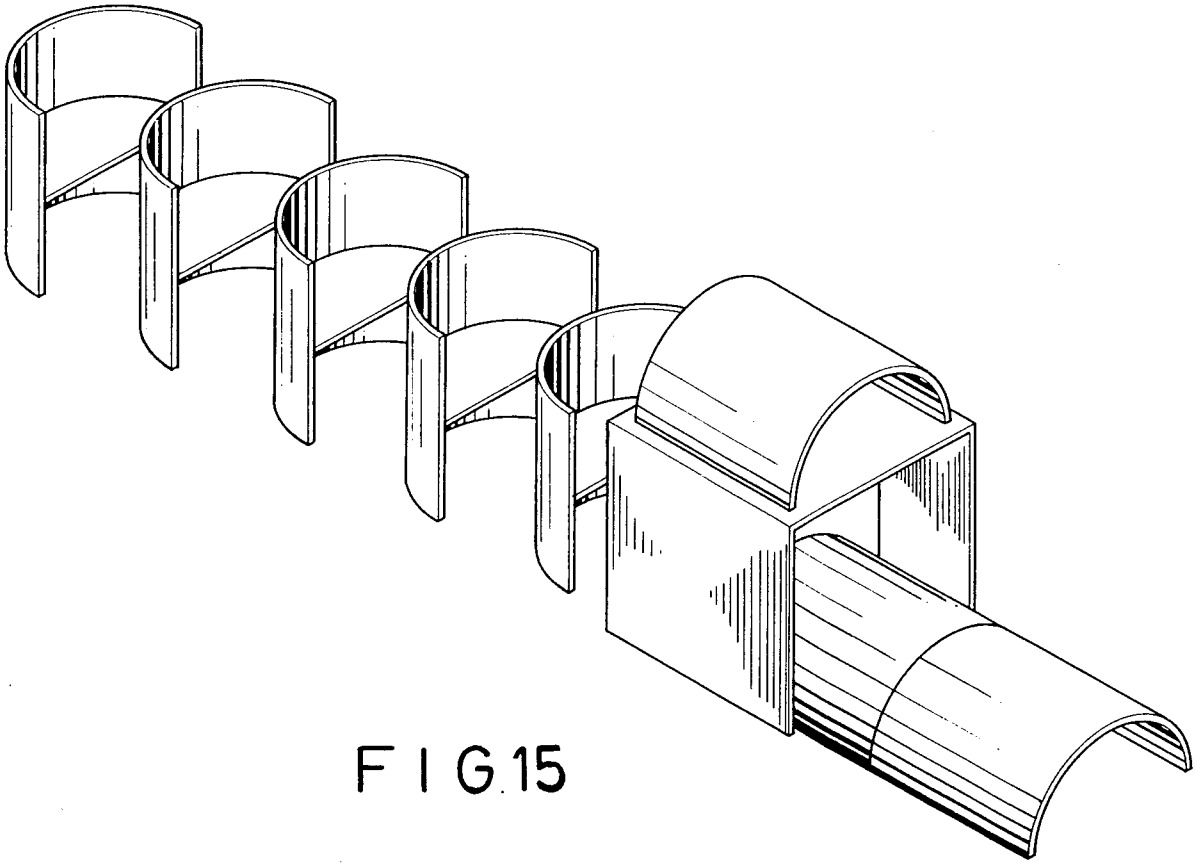
FIG. 15 is a perspective view of a twelveth combination made with units of building blocks.
Figure 16:
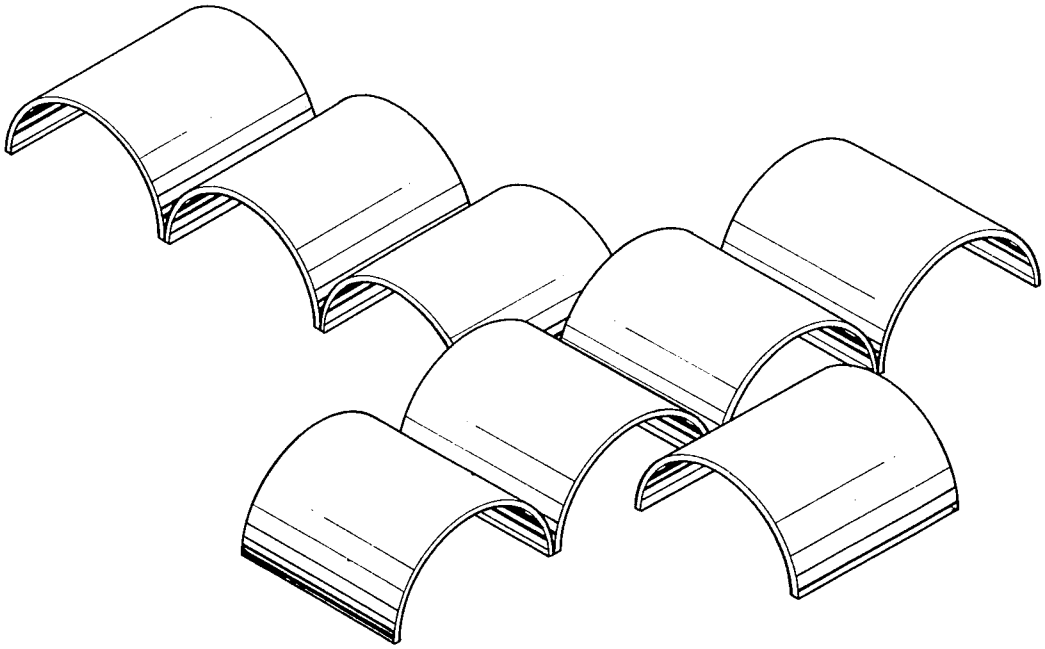
FIG. 16 is a perspective view of a thirteenth combination made with units of building blocks.
Figure 17:
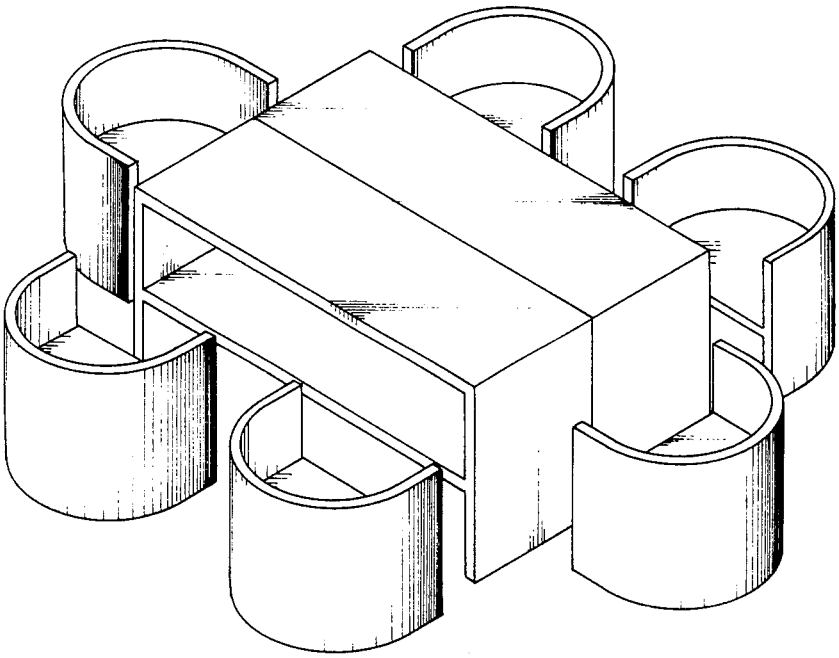
FIG. 17 is a perspective view of an alternate combination made with units of building blocks.
Figure 18:
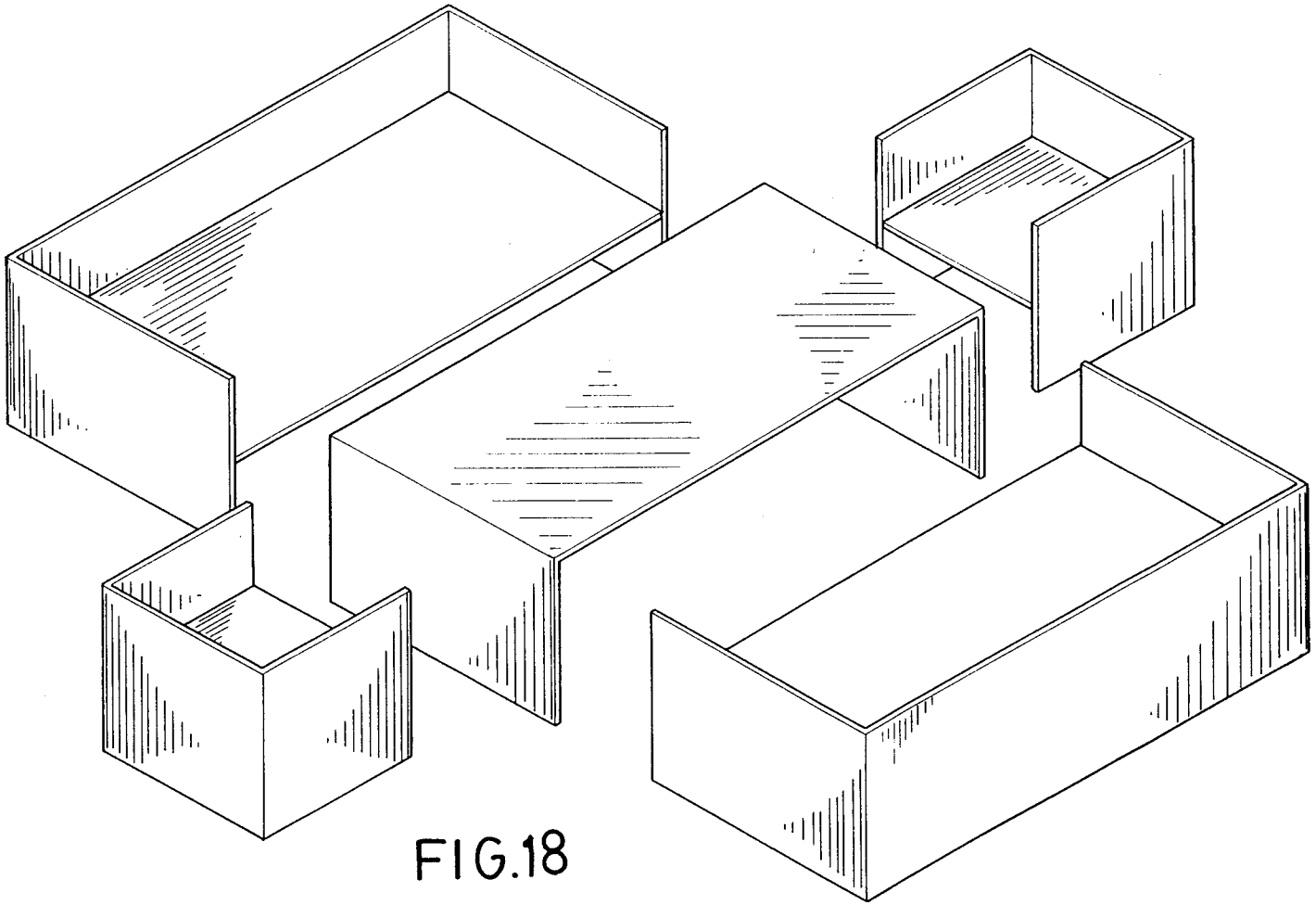
FIG. 18 is a perspective view of a different type of conventional building blocks showing different combination.

Referring to FIG. 1, it can be seen that the present invention comprises a supporting partition wall (1) and a horizontal partition plate (2) which divides the unit into an upper compartment (3) and a lower compartment (4), further, the horizontal partition plate (2) can be mounted at either the top or the bottom edge of the supporting partition wall (1), wherein, the surface of supporting partition wall (1) at the upper compartment is drilled with a row of equally spaced holes (11) which allow for engagement with other units of building blocks. Engagement is made when the surface of respective unit come into contact with each other and are screwed together. The lateral edge of horizontal partition plate (2) is perpendicularly mounted to the surface of supporting partition wall (1) by means of a dowel (as shown in FIG. 1A) or flat-top screw (as shown in FIG. 1B). In the preferred embodiment shown in FIG. 2, the shape of supporting partition wall (1) is made to be an inverted U-shaped and securely fitted with a horizontal partition plate (2), a table or chair for children thus being formed. Each building block unit can be regarded independently as an individual unit and can be arranged together to form familiar object of many kinds. The major characteristic of the present invention is that the units can be made into any trigonometrical shape such as a square, rectangle, semi-circular, trapezoidal sector and etc. (as shown in FIG. 3), the size of such unit is comparable to the size of children, therefore, all these units can easily be stored when not in use, in addition, the children can have different imagination and designs, stack or combine the units into attractive and useful arrangement. These block units can be joined to each other by dowel or screw tightening, or stacked with one another to form different combinations.

FIG. 4 to FIG. 17 are different combinations of preferred embodiments. No matter what combinations created or designed by the children, these combinations are useful as furniture or as toy game. The children spend time to complete their arrangement, as a result, they are sure to be content, proud to be able to creat some other new designs by themselves.

Obviously, many other modifications and variations of the present invention are possible in the light of the above principles, but these obvious variations are deemed to fall within the scope of this invention as defined in the appended claims.

According to the aspect of the present invention, the multi-purpose building blocks each have a block body of the shape capable of representing many kinds of combinations. Each of the blocks is the same height, such that other blocks of different shapes can be mounted together at one of the faces to form other combinations.

I claim:

1. A multi-purpose building block unit for a building block set wherein each block unit comprises:

(a) a generally vertically extending supporting partition wall defining a pair of opposite distal edges, the supporting partition wall defining a concave shape having an open side and comprising a generally planar base segment and two generally planar side segments extending from opposite sides of the base segment, the side segments forming an angle of 60° to 90° therebetween;

(b) a generally horizontally extending partition plate attached to the supporting partition wall and extending across the concave shape so as to divide the block unit into upper and lower compartments, the partition plate defining a single, continuous edge extending between the distal edges of the supporting partition wall; and (c) at least one row of holes defined by the supporting partition wall in the upper compartment, the holes adapted to engage fastening means to fasten a plurality of the block units together to form a multiplicity of combinations.

2. The building block unit according to claim 1 wherein the single, continuous edge of the partition plate extends in a substantially straight line between the distal edges of the supporting partition wall such that the partition plate has the shape of a truncated triangle.

3. The building block unit according to claim 1 wherein the single, continuous edge of the partition plate is curved between the distal edges of the supporting partition wall such that the partition plate has the shape of a truncated sector.

* * * * *